US007027757B2

(12) United States Patent
Jeong

(10) Patent No.: US 7,027,757 B2
(45) Date of Patent: Apr. 11, 2006

(54) IMAGE FORMING APPARATUS INCLUDING A SUBSIDIARY TRANSFER PART HAVING A FIBER OPTIC GUIDE

(75) Inventor: Su-jong Jeong, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/387,859

(22) Filed: Mar. 14, 2003

(65) Prior Publication Data

US 2003/0202820 A1 Oct. 30, 2003

(30) Foreign Application Priority Data

Apr. 24, 2002 (KR) ..... 2002-22380

(51) Int. Cl.
*G03G 21/00* (2006.01)
*G03G 15/16* (2006.01)

(52) U.S. Cl. ..... 399/128; 399/296

(58) Field of Classification Search ..... 355/1; 399/128, 129, 296
See application file for complete search history.

(56) References Cited

U.S. PATENT DOCUMENTS 4,468,110 A * 8/1984 Tanigawa et al. ..... 399/296
4,534,641 A * 8/1985 Gilliland et al. ..... 355/1
6,198,088 B1 * 3/2001 Seachman
6,324,373 B1 * 11/2001 Park ..... 399/296
6,356,726 B1 * 3/2002 Campbell et al. ..... 399/128

FOREIGN PATENT DOCUMENTS

JP 60247259 A * 12/1985
JP 02027381 A * 1/1990
JP 2002044378 A * 2/2002
JP 2003066797 A * 3/2003

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

An image forming apparatus includes a developing device having a photosensitive element rotating in a given direction to form a latent electrostatic image on a surface thereof through a laser scanning unit, and a developing roller developing the latent electrostatic image into a toner image using a developer, a transfer part transferring the toner image onto a transported printing paper disposed on a paper-transporting path to engage the photosensitive element, and a subsidiary transfer part having at least one light source disposed on at least one of both sides of the paper-transporting path to expose the photosensitive element to light and thereby to enhance a transfer efficiency, and an optic fiber guide disposed longitudinally along the photosensitive element to lead the light generated from the light source to the photosensitive element.

39 Claims, 6 Drawing Sheets

IMAGE FORMING APPARATUS INCLUDING A SUBSIDIARY TRANSFER PART HAVING A FIBER OPTIC GUIDE

CROSS-REFERENCE TO RELATED APPLICATIONS

This application claims the benefit of Korean Patent Application No. 2002-22380, filed Apr. 24, 2002, in the Korean Intellectual Property Office, the disclosure of which is incorporated herein by reference.

BACKGROUND OF THE INVENTION

1. Field of the Invention

The present invention relates to an image forming apparatus having a pre-transfer lamp adapted for use in an office machine, such as an electro-photograph type printer, a copying machine, and a facsimile machine (FAX), and more particularly, to an image forming apparatus including a subsidiary transfer part having an optic fiber guide leading light emitted from a pre-transfer lamp onto a photosensitive element, such as a photosensitive drum, to expose the photosensitive element to light, thereby transferring a toner image efficiently onto a printing paper.

2. Description of the Related Art

Generally, an image forming apparatus which is applied to an office machine, such as a copying machine, a FAX, and a printer, comprises a laser scanning unit (LSU) forming a latent electrostatic image on a photosensitive element, such as a photosensitive drum, by scanning light fluxes, such as laser beams, thereon according to image signals, and an image forming part developing the latent electrostatic image on the photosensitive element using a developer composed of toner of given colors to form a toner image and transferring the toner image onto a printing paper to obtain a required image. The toner image transferred onto the printing paper is fixed thereon through a fusing part fusing (fixing) the toner image, and the fixed printing paper is then discharged outwardly from the office machine by a discharging part.

Lately, pre-transfer lamps, such as light-emitting diodes (LED), are disposed as a subsidiary transfer part to decrease or lower an electrical potential on a surface of the photosensitive drum, thereby enhancing a transfer efficiency in a transfer operation by exposing the photosensitive drum to light before the toner image is transferred onto the printing paper.

Referring now to FIG. 1, a conventional developing device 10 and its circumferential devices are schematically illustrated to form an image forming part of a conventional image forming apparatus, in which pre-transfer lamps are disposed.

The conventional image forming apparatus comprises a photosensitive drum 11 disposed to project partially and downwardly from the developing device 10, and a transfer roller 18 disposed to project partially toward a paper-transporting passage 20 defined by upper and lower frames 21, 22 of a main body of the image forming apparatus. The photosensitive drum 11 and the transfer roller 18 are arranged to contact each other with a given pressure when the developing device 10 is mounted on the main body.

At one side of the photosensitive drum 11, a charging roller 12 charging a surface of the photosensitive drum 11 to a high voltage is disposed to come in contact therewith, whereas at the other side of the photosensitive drum 11, a developing roller 13 supplying toner 15 onto the photosensitive drum 11 is disposed to rotate in a slightly spaced-apart relation therewith. Also, at one side of the developing roller 13, a toner-supplying roller 14 supplying the toner 15 from a toner container 16 of the developing device 10 to the developing roller 13 is arranged to come in contact with the developing roller 13 and to rotate in the same direction as the photosensitive drum 11.

Over the photosensitive drum 11 between the charging roller 12 and the developing roller 13, a laser scanning unit (LSU) 17 forming a latent electrostatic image on the surface of the photosensitive drum 11 charged with the high voltage by the charging roller 12 is disposed.

In the lower frame 21 of the main body forming the paper-transporting passage 20 below the photosensitive drum 11 of the developing device 10, a transfer roller 18 is disposed to engage the photosensitive drum 11, and at an upstream side of the transfer roller 18 in a paper-transporting direction, a printed circuit board 30 having a plurality of pre-transfer lamps 31 is disposed in the lower frame 21.

The pre-transfer lamps 31 are covered with a transparent cover 32, so that they can be protected. The pre-transfer lamps 31 function to expose the surface of the photosensitive drum 11 to light so as to lower an electrical potential thereof before a toner image is transferred onto a printing paper 50 by the transfer roller 18 later on, and thereby to increase the transfer efficiency.

However, the image forming apparatus described above has a structure in which the surface of the photosensitive drum 11 is exposed to the light passing through the printing paper 50, since the pre-transfer lamps 31 are disposed in the lower frame 21 below the paper-transporting passage 20. Therefore, according to a thickness of the printing paper 50, transmissivity of the light becomes different. As a result, a difference in an erasing capacity of the pre-transfer lamps 31 occurs. Accordingly, when the transmissivity of the light is decreased by the thickness of the printing paper 50, the transfer efficiency is lowered.

Also, in the conventional image forming apparatus, a plurality of the pre-transfer lamps 31, for example, 16 pre-transfer lamps, having a relatively low intensity of radiation should be longitudinally arranged along the photosensitive drum 11 since the pre-transfer lamps 31 are disposed to be close to the photosensitive drum 11. In this case, an uneven radiation of the pre-transfer lamps 31 results in a Ver-steak phenomenon, in which the photosensitive drum 11 is unevenly exposed to light due to luminosity declination of the respective pre-transfer lamps 31. Also, a fabrication cost may be increased since the pre-transfer lamps 31 are used and spaced-apart from each other.

To solve these problems, there has been proposed another image forming apparatus having a pre-transfer lamp and a light guide formed as a subsidiary transfer part not to interfere with a transported printing paper.

Referring to FIG. 2, a developing device 10' and circumferential devices of the image forming apparatus include pre-transfer lamps 31' and a light guide 40.

As illustrated in FIG. 2, the developing device 10' of the image forming apparatus comprises the pre-transfer lamps 31' disposed on a printed circuit board 30' on an upper frame 22' of a main body forming a paper-transporting passage 20' of a printing paper 50', and a light guide 40 having a wide width disposed between the pre-transfer lamps 31' and a photosensitive drum 11' to lead (guide) light emitted from the pre-transfer lamps 31' onto a surface of the photosensitive drum 11'. The developing device 10' includes a toner container containing toner 15', a toner supply roller 14', a developing roller 13', and a toner layer regulating blade **13*a***.

The image forming apparatus further includes a photosensitive drum 11', a charging roller 12', a lower frame 21', and a toner container 16', and laser scanning unit 17', a transfer roller 18'.

Referring to FIG. 3, the light guide 40 formed of acryl material has an inclined surface 41 formed parallel with the surface of the photosensitive drum 11' at an end thereof to radiate light in a direction vertical to the surface of the photosensitive drum 11'.

However, in the image forming apparatus described above, the problem causing a variation of the transmissivity of the light according to the thickness of the printing paper 50' might be solved by using the light guide 40 having the wide width to lead (guide) light from the pre-transfer lamps 31' onto the photosensitive drum 11' above the printing paper 50' and then to expose the surface of the photosensitive drum to light, but a new problem occurs in that a large space is required to dispose the light guide 40 having a bulky size between the pre-transfer lamps 31' and the photosensitive drum 11', thereby resulting in an increase in size of the image forming apparatus.

Also, in the image forming apparatus, there is a problem that a large number of the pre-transfer lamps 31' should be still used to expose an overall surface of the photosensitive drum 11' uniformly to the light.

SUMMARY OF THE INVENTION

Therefore, it is an aspect of the present invention to provide an improved image forming apparatus including a subsidiary transfer part having an optic fiber guide, which not only enhances a transfer efficiency by exposing a photosensitive drum uniformly to light, but also can be manufactured at a low cost without requiring a large establishment space.

It is another aspect of the present invention to provide an improved image forming apparatus including an erasing part having an optic fiber guide, which not only enhances an erasing efficiency by exposing a photosensitive drum uniformly to light, but also can be manufactured at a low cost without requiring a large establishment space.

Additional aspects and advantages of the invention will be set forth in part in the description which follows and, in part, will be obvious from the description, or may be learned by practice of the invention.

These and/or other aspects of the invention are achieved by providing an image forming apparatus comprising a developing device having a photosensitive element rotating in a given direction to form a latent electrostatic image on a surface thereof through a laser scanning unit, and a developing roller developing the latent electrostatic image into a toner image with a developer, a transfer part transferring the toner image onto a transported printing paper disposed on a paper-transporting path to engage the photosensitive element, and a subsidiary transfer part having at least one light source disposed on at least one of both sides of the paper-transporting path to evenly expose the photosensitive element to light and thereby enhance a transfer efficiency, and an optic fiber guide disposed longitudinally along the photosensitive element to lead (guide) light generated from the light source to the photosensitive element.

According to another aspect of the invention, the optic fiber guide includes a core having a light-influx surface disposed toward the light source and a light-diffusion surface disposed toward the photosensitive element to lead (guide) the light toward the photosensitive element, and a reflection part disposed on an outer surface of the core to diffuse and reflect the light toward the light-diffusion face of the core.

The core has cladding formed on the outer surface of the core except for the light-influx surface and the light-diffusion surface. Alternatively, in a case that the optic fiber guide includes a holder fixing the optic fiber guide, which is formed to expose the light-influx surface and the light-diffusion surface to an outside of the core, on a frame of the image forming apparatus so as to lead the light toward the photosensitive element from the light source, the cladding can be omitted.

The reflection part includes a plurality of fluorescent material surfaces, each of which is formed to have a different area according to a distance from the light source. According to another aspect of the invention, it is possible that the fluorescent material surfaces have smaller areas when the fluorescent material surfaces are disposed closer to the light source. The areas of the fluorescent material surfaces may vary in response to a distance between the light source and a location of the fluorescent material surfaces.

Also, it is possible that the light source includes a pre-transfer lamp having at least one LED. According to another aspect of the present invention, an image forming apparatus comprises a developing device having a photosensitive element rotating in a given direction to form a latent electrostatic image on a surface thereof through a laser scanning unit, and a developing roller developing the latent electrostatic image into a toner image using a developer, a transfer part transferring the toner image onto a transported printing paper disposed on a paper-transporting path to engage with the photosensitive element, and an erasing part having at least one eraser lamp disposed on at least one of both sides of the photosensitive element over the photosensitive element to erase electric charges remaining on the surface of the photosensitive element after the toner image is transferred onto the transported printing paper by the transfer part, and an optic fiber guide disposed longitudinally along the photosensitive element to lead light generated from the eraser lamp onto the photosensitive element.

BRIEF DESCRIPTION OF THE DRAWINGS

The foregoing and/or other aspects, features and advantages of the invention will be apparent and more readily appreciated from the following description of the preferred embodiment of the invention, taken in conjunction with the accompanying drawings of which

DETAILED DESCRIPTION OF THE PREFERRED EMBODIMENTS

Figure 1:
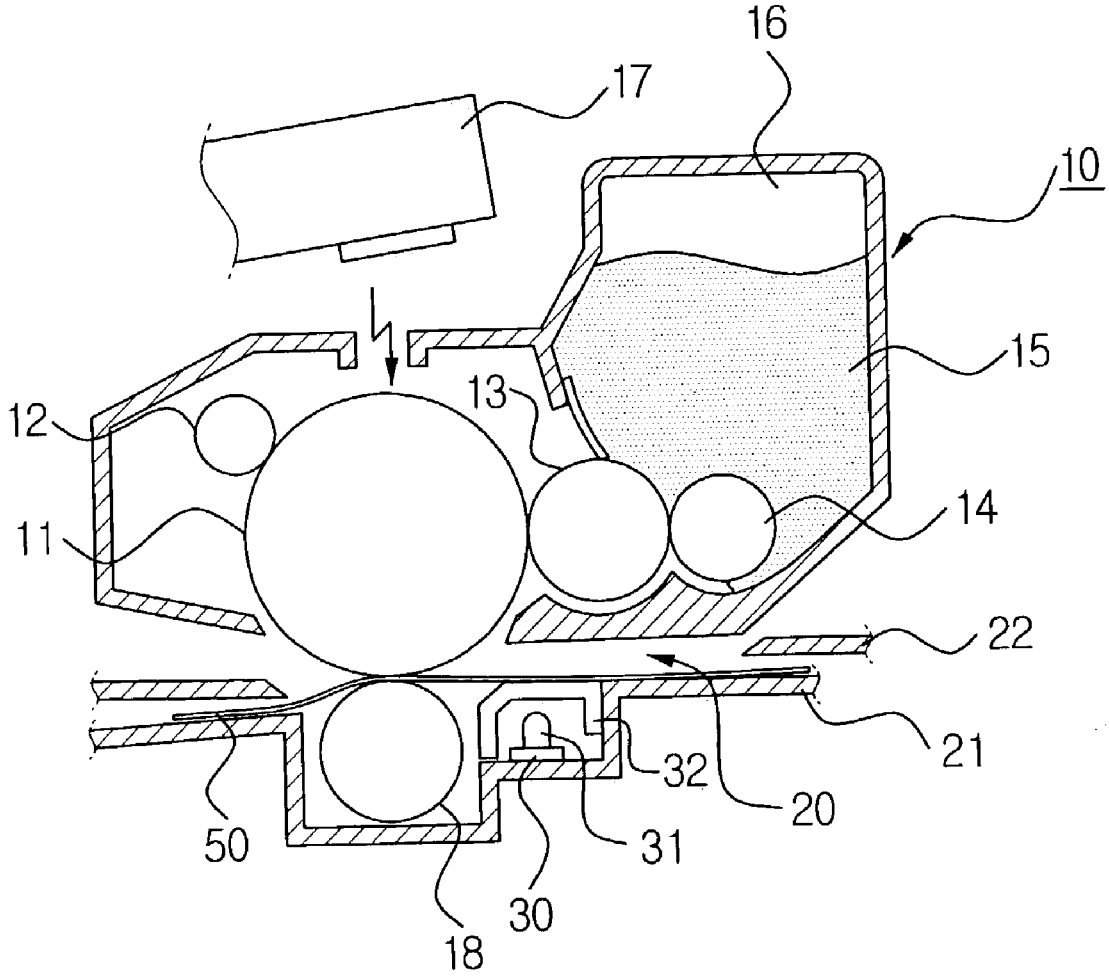
FIG. 1 (PRIOR ART)
FIG. 1 is a schematic cross-sectional view of a developing device and circumferential devices of a conventional image forming apparatus.
Figure 2:
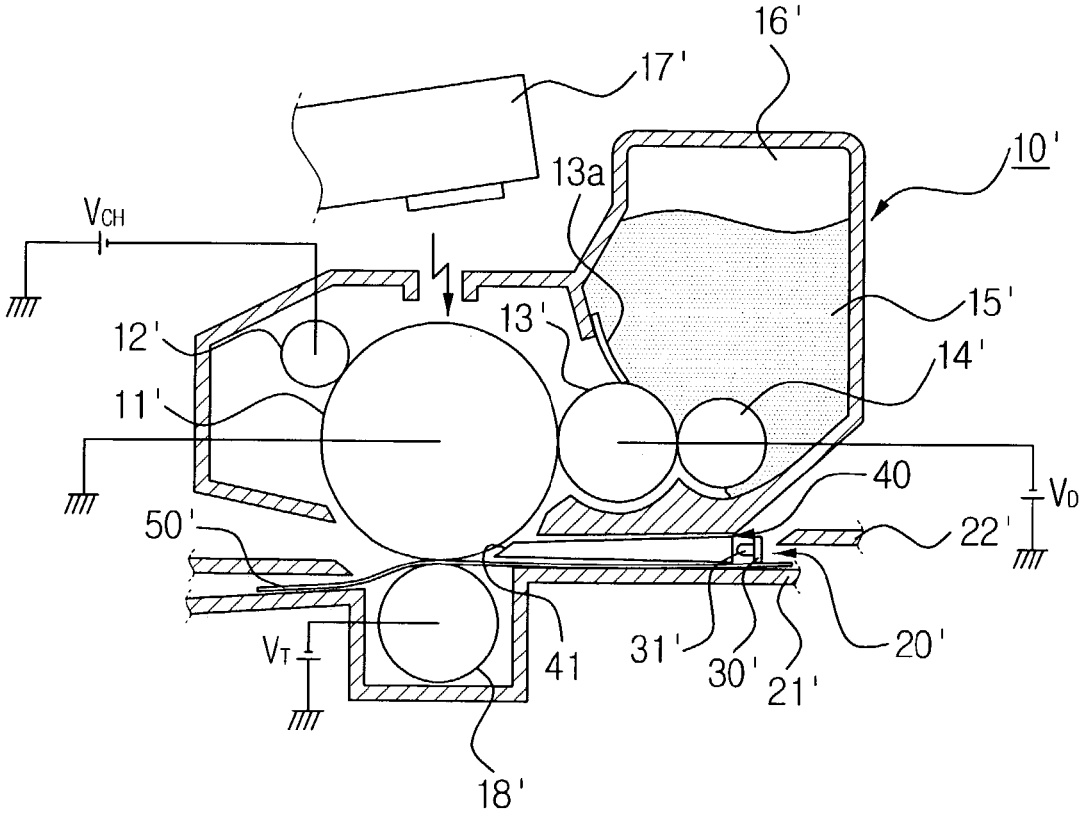
FIG.2 (PRIOR ART)
FIG. 2 is a schematic cross-sectional view of a developing device and circumferential devices of another conventional image forming apparatus.
Figure 3:
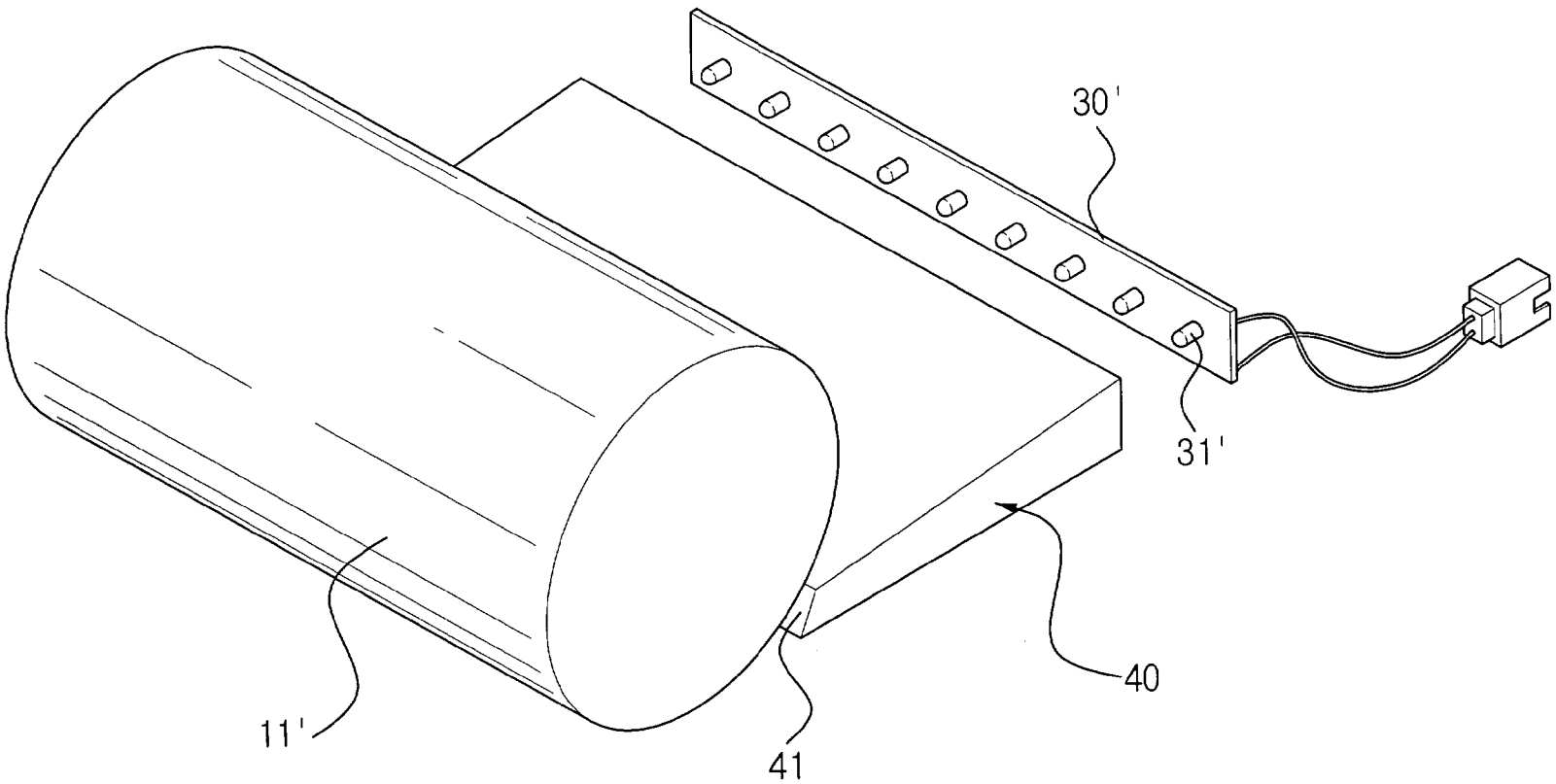
FIG.3 (PRIOR ART)
FIG. 3 is a perspective view of pre-transfer lamps having a light guide of the image forming apparatus illustrated in FIG. 2.

Reference will now be made in detail to the present preferred embodiment of the present invention, an example of which is illustrated in the accompanying drawings, wherein like reference numerals refer to the like elements throughout. The embodiment is described in order to explain the present invention by referring to the figures.

The present invention now will be described more fully hereinafter with reference to the accompanying drawings, in which an embodiment of the invention is shown.

Figure 4:
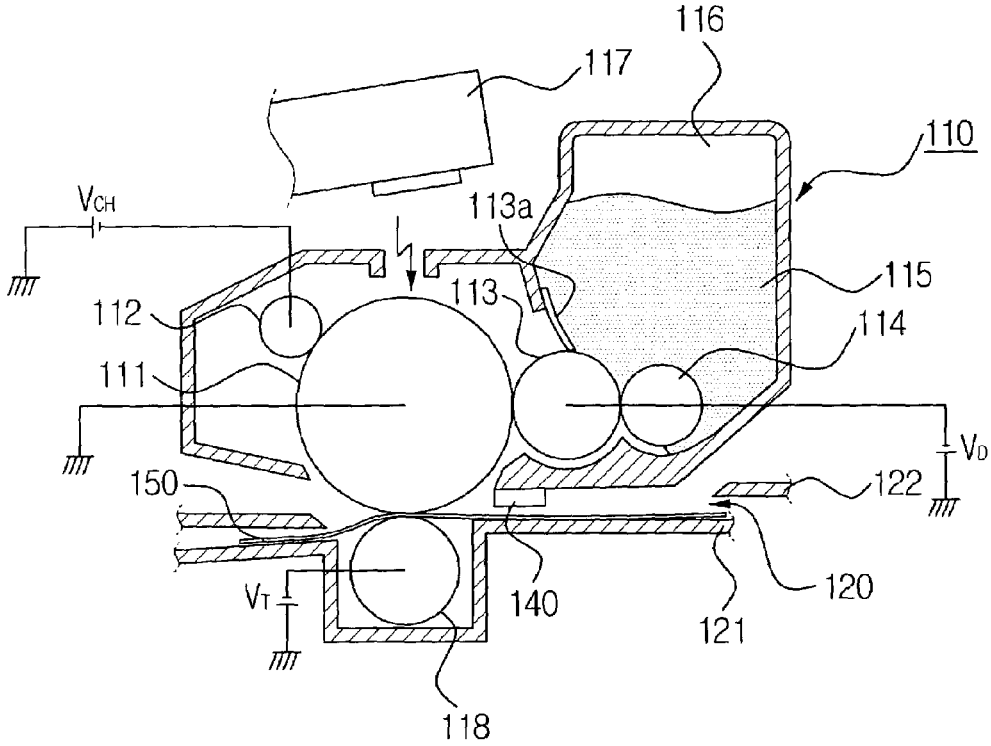
FIG. 4 is a schematic cross-sectional view of an image forming apparatus in accordance with an embodiment of the present invention.

Referring now to FIG. 4, there is schematically illustrated a developing device 110 and its circumferential devices of an image forming apparatus in accordance with an embodiment of the present invention.

The image forming apparatus of the present invention includes a developing device 110 having a photosensitive drum 111 rotatably disposed to form a latent electrostatic image on a surface thereof through a laser scanning unit (LSU) 117 having a laser source, a charging roller 112 charging the surface of the photosensitive drum 111 to a high voltage and disposed to come in contact with one side of the photosensitive drum 111 and rotate therewith, and a developing roller 113 developing the latent electrostatic image with toner 115 to form a toner image and disposed in a slightly spaced-apart relation with another side of the photosensitive drum 111 and rotate therewith. A toner-supplying roller 114 is disposed at one side of the developing roller 113 of a toner container 116 to come in contact with the developing roller 113 to rotate therewith to supply the toner 115 contained in the toner container 116 to the developing roller 113. Also, over the developing roller 113, a toner layer-regulating blade 113*a* regulating a thickness of the toner 115 supplied onto the developing roller 113 by the toner-supplying roller 114 is arranged.

Lower and upper frames 121, 122 are formed on a main body of the image forming apparatus to provide a paper-transporting passage 120 therebetween. A transfer roller 118 as a transfer part is disposed on the lower frame 121 of the main body and is projected partially toward the paper-transporting passage 120 from the lower frame 121 to contact the photosensitive drum 111 with a given pressure in the developing device 110.

Also, the image forming apparatus of the present invention includes a pre-transfer lamp assembly 140 as a subsidiary transfer part exposing the surface of the photosensitive drum 111 to light to lower or decrease an electrical potential thereof, thereby to improve a transfer efficiency. The pre-transfer lamp assembly 140 is disposed on the upper frame 122 of the main body not to interfere with a printing paper 150.

Figure 5:
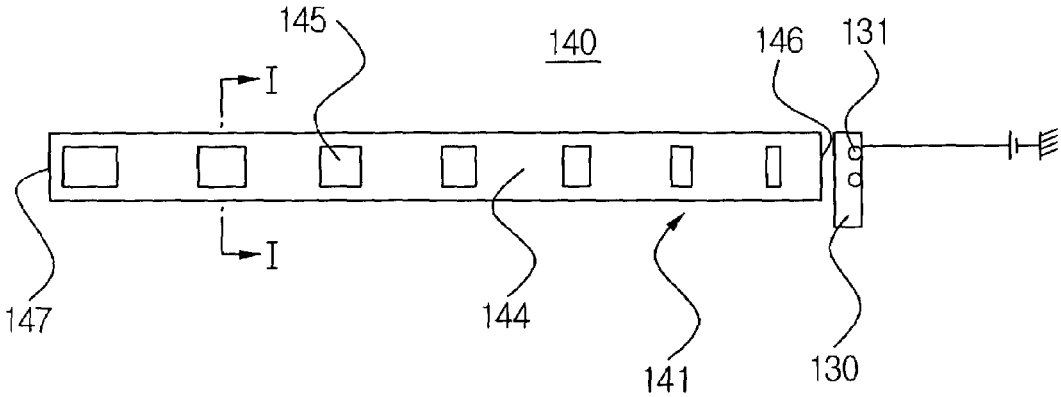
FIG. 5 is a top plan view of a pre-transfer lamp assembly of the image forming apparatus illustrated in FIG. 4.

As illustrated in FIG. 5, the pre-transfer lamp assembly 140 is provided with a pre-transfer lamp 131 having two LEDs formed on a printed circuit board 130 which is disposed at one side portion of the upper frame 122 on the paper-transporting passage 120 adjacent to an upstream side of the transfer roller 118 in a paper-transporting direction, and an optic fiber guide 141 leading (guiding) the light generated from the pre-transfer lamp 131 onto the surface of the photosensitive drum 111, and fixed on the upper frame 122 longitudinally along the photosensitive drum 111 by an adhesive agent or a fixing holder (not shown).

Here, although the pre-transfer lamp 131 is explained to have two LEDs, it is possible that the pre-transfer lamp 31 includes one LED or more than two LEDs according to a required intensity of radiation of the light of the pre-transfer lamp 131.

Figure 6:
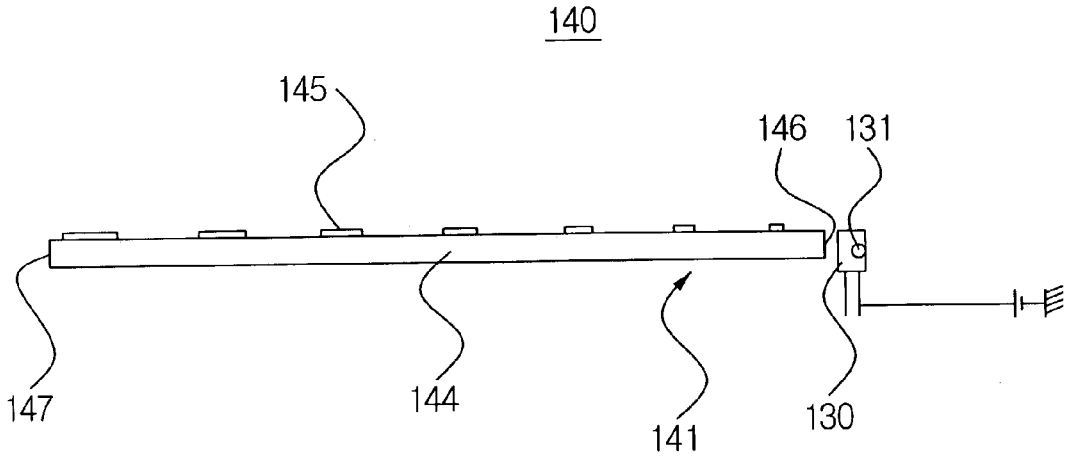
FIG. 6 is a front view of the pre-transfer lamp assembly of the image forming apparatus illustrated in FIG. 4.
Figure 7:
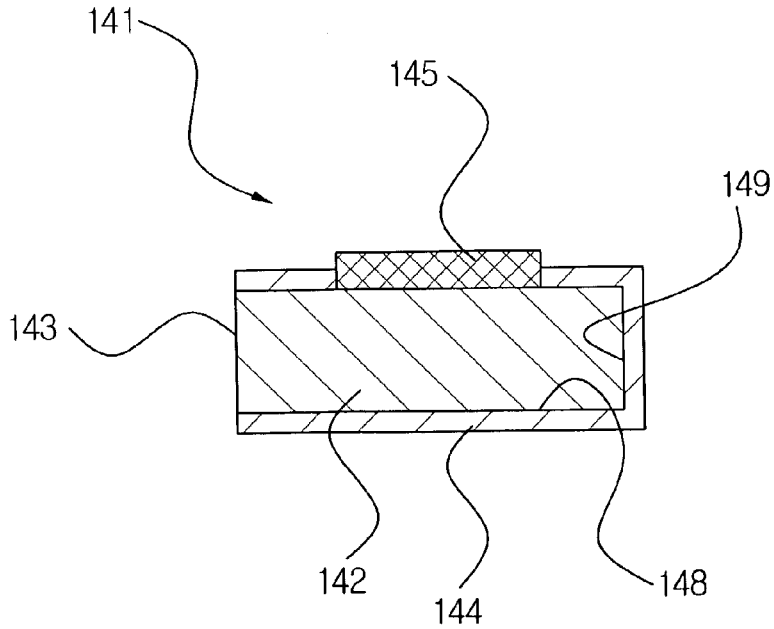
FIG. 7 is a cross-sectional view of an optic fiber guide of the pre-transfer lamp assembly taken along line I—I of FIG. 5.

As illustrated in FIG. 5 to FIG. 7, the optic fiber guide 141 in a form of a bar with rectangular section includes a core 142 having a light-influx end surface 146 disposed toward the pre-transfer lamp 131 and a light-diffusion surface 143 disposed opposite to the surface of the photosensitive drum 111 to lead (guide) light toward the surface of the photosensitive drum 111, and a reflection part 145 disposed on an upper portion of an outer surface of the core 142 to allow the light coming in (transmitted into) the core 142 through the light-influx end surface 146 to be diffused and reflected through the light-diffusion surface 143 toward the surface of the photosensitive drum 111.

On an outer surface of the core 142 except for the light-influx end face 146 and the light-diffusion face 143, cladding 144 is disposed. The cladding 144 is formed of a material having an index of refraction lower than that of the core 142 to be able to maintain the light in the core 142. On an end surface 147 of the optic fiber guide 141 disposed opposite to the light-influx end surface 146, a light-interception cover or a plug (not shown) is disposed to prevent the light from passing therethrough and further proceeding, instead of the cladding 144.

The core 142 can be formed of a light wave transmission material which is transparent at a normal temperature, preferably amorphous and stable to the light, for example, a plastic optic fiber (POF), such as methyl methacrylate, ethyl acrylate, butyl methacrylate, and butyl acrylate, or a glass optic fiber (GOF), such as doped silica in which a dopant, such as titanium oxide, tantalum oxide, aluminum oxide, lanthanum oxide, oxophosphoric acid, or germanium oxide, is added to obtain a proper index of refraction.

The cladding 144 can be formed of a POF material having an index of refraction lower than that of the core 142, such as alkyl acrylate and fluorinated polymer selected from a group consisting of 2,2,2-trifluoroethyl methacrylate, trihydroperfluoroprophyl methacrylate, and 1,1,5-trihydroperfluoropentyl acrylate or methacrylate; or a GOF material, such as pure silica, and silica doped to have an index of refraction lower than that of the core 142.

Alternatively, in a case that the holder fixing the optic fiber guide 141 on the upper frame 122 is used, the fixing holder is formed to open or expose the light-influx end surface 146 and the light-diffusion surface 143 to the outside of the core 142 so as to lead the light toward the surface of the photosensitive drum 111, so that the cladding 144 can be omitted.

The reflection part 145 includes a plurality of plates or coated surfaces formed of the fluorescent material and formed to have a different area according to a distance or a location of the respective plates or coated surfaces from the pre-transfer lamp 131. Particularly, it is possible that the fluorescent material surfaces have a smaller area as much as they are positioned closer to the pre-transfer lamp 131.

Also, the reflection part 145 can be disposed at a bottom portion 148 and a side portion 149 of the outer surface of the core 142 opposite to the light-diffusion surface 143, instead of being disposed at an upper portion of the outer surface of the core 142.

As the fluorescent material forming the plates or the coated surfaces of the reflection part 145, a general fluorescent pigment can be used. For example, an inorganic pigment, such as zinc sulfide and zinc-cadmium sulfide compound; an organic pigment, such as sodium red lake C, rhodamine tungstate, and auramine tungstate; and alkyd resin varnish or acrylic acid resin varnish can be used as the fluorescent material.

Thus, when the light emitted from the pre-transfer lamp 131 is transmitted into the core 142 through the light-influx end surface 146 thereof, an intensity of radiation in the light is uniformly controlled by the reflection part 145 even though the light recedes from the pre-transfer lamp 131, and thereby the light can be uniformly reflected (transmitted) toward the surface of the photosensitive drum 111 through the light-diffusion surface 143.

Here, it should be noted that in the image forming apparatus of the invention, the pre-transfer lamp 131 is explained as disposed at only one side of the optic fiber guide 141, but it can be disposed at both sides of the optic fiber guide 141 and at same time, the fluorescent material plates of the reflection part 145 can be formed to have a larger area when the fluorescent material plates of the reflection part 145 are disposed closer to a middle portion of the optic fiber guide 141, and a smaller area when the fluorescent material plates of the reflection part 145 are disposed farther from the middle portion of the optic fiber guide 141. The areas of the fluorescent material plates of the reflection part 145 may vary according to a distance between the light source and each location of the fluorescent material plates.

Further, the optic fiber guide 141 is explained as formed in a form of a bar having the rectangular section, but it can be formed of any other structure, for example a cylindrical rod shape or a hollow pipe shape, which can properly guide the light.

Also, the materials of the core 142, the cladding 144, and the reflection part 145 are not limited as the specific materials described above, but any other optic fiber materials having a proper index of refraction can be used.

As described above, since the pre-transfer lamp assembly 140 is provided with the optic fiber guide 141 having a narrow width and the pre-transfer lamp 131 having two LEDs disposed at one side of the optic fiber guide 141, the image forming apparatus of the present invention not only uniformly exposes the surface of the photosensitive drum 111 to the light to enhance the transfer efficiency, but also be manufactured at a low cost without requiring a large establishment space in the image forming apparatus.

Now, an operation of the image forming apparatus of the present invention will be described in details with reference to FIGS. 4 through 7.

First, as illustrated in FIG. 4, when the photosensitive drum 111 is rotated to be in contact with the charging roller 112, the charging roller 112 charges the surface of the photosensitive drum 111 by a charging voltage VCH supplied thereto. For example, the surface of the photosensitive drum 111 can be charged to the high voltage of about −800V. And then, the LSU 117 scans laser beams on the charged surface of the photosensitive drum 111 to lower the electric potential thereof, and thereby to form a latent electrostatic image thereon. At this time, in the charged surface of the photosensitive drum 111, a scanned portion in which the latent electrostatic image is formed by the LSU 117 has an electric potential of about −80V, whereas a non-scanned portion in which the latent electrostatic image is not formed has the same electric potential of about −800V as that supplied from the charging roller 112.

After that, as the photosensitive drum 111 is rotated in the slightly spaced-apart relation with the developing roller 113, a developing voltage VD of about −300V supplied to the developing roller 113 is transferred into the toner 115, so that the toner 115 is attached to the scanned portion of the surface of the photosensitive drum 111 having a relatively higher voltage than that of the non-scanned portion thereof to form the toner image.

Thereafter, the light generated from the pre-transfer lamp 131 is transmitted to the core 142 through the light-influx end surface 146 disposed toward the pre-transfer lamp 131, is moved longitudinally along the core 142, being diffused by the fluorescent material plates or the surfaces of the reflection part 145 disposed on an upper portion of the outer surface of the core 142, and is then emitted toward the surface of the photosensitive drum 111 through the light-diffusion surface 143. At this time, since the fluorescent material surfaces of the reflection part 145 have the larger area as much as they are positioned apart from the pre-transfer lamp 131, the intensity of radiation of the light emitted through the light-diffusion surface 143 is uniformly controlled even though the light recedes from the pre-transfer lamp 131.

Thus, the scanned and non-scanned portions of the surface of the photosensitive drum 111 are simultaneously evenly exposed to the light emitted toward the photosensitive drum 111 through the light-diffusion surface 143, such that electric potentials thereof are lowered. For example, the electric potential of the scanned portion can be decreased below about −80V, whereas the electric potential of the non-scanned portion can be decreased below about −600V. Accordingly, since the electric potential of the non-scanned portion positioned at edges of the latent electrostatic image is decreased, a large energy or voltage is not required in a transfer operation of the toner image later on and thereby the transfer efficiency is also improved.

After that, the toner image on the photosensitive drum 111 is transferred onto the printing paper 150 passing through the paper-transporting passage 120 between the photosensitive drum 111 and the transfer roller 118 by a transfer voltage VT of about 1.2 KV supplied to the transfer roller 118.

Figure 8:
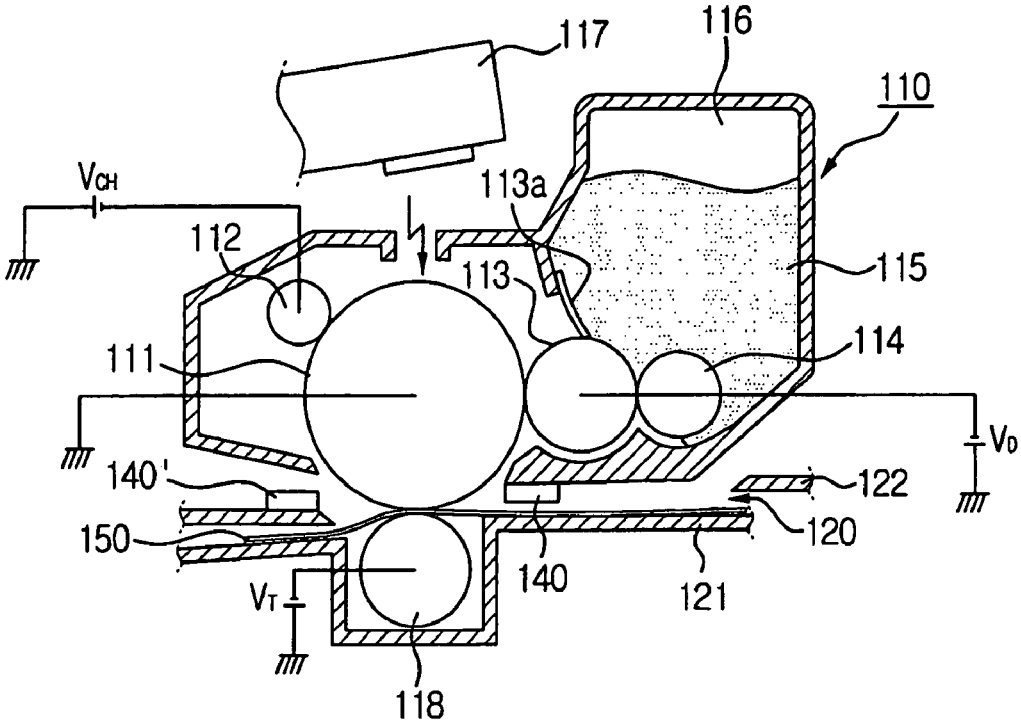
FIG. 8 is a schematic cross-sectional view of the image forming apparatus of FIG. 4 including an eraser lamp assembly.

As described above, in the image forming apparatus of the present invention, the pre-transfer lamp assembly 140 having the optic fiber guide 141 and the pre-transfer lamp 131 is explained as used only as a subsidiary transfer part, but the present invention is not limited to that, and an erasing lamp assembly 140' (shown in FIG. 8) having the same structure as that of the pre-transfer lamp assembly 140 may be used as an erasing part erasing electric charges remaining on the surface of the photosensitive drum 111 after the toner image is transferred onto the printing paper 150 by the transfer roller 118.

A structure and an operation of the erasing lamp assembly will not be explained in detail since they are substantially the same as those of the pre-transfer lamp assembly 140.

As is apparent from the foregoing description, it can be appreciated that the subsidiary transfer part and/or the erasing part of the image forming apparatus of the present invention provides an effect that not only requires a relatively small space compared to the large establishment space of a conventional image forming apparatus, but also allows the surface of the photosensitive drum to be efficiently exposed to light by using the optic fiber guide having a narrow width in a direction parallel to the photosensitive drum.

Further, the image forming apparatus of the present invention can uniformly expose the surface of the photosensitive drum to the intensity of radiation of the light, thereby obtaining a uniform transfer or an erasing efficiency by controlling areas of the fluorescent material surfaces of the reflection part positioned on the outer surface of the optic fiber guide.

Also, the image forming apparatus of the present invention provides an effect that can use a few LEDs and has a simplified structure to obtain a required performance in a low cost.

Although an embodiment of the present invention has been shown and described, it would be appreciated by those skilled in the art that changes may be made in this embodiment without departing from the principles and sprit of the invention, the scope of which is defined in the claims and their equivalents.

What is claimed is:

1. An image forming apparatus, comprising:

a laser scanning unit;

a developing device having a photosensitive element rotating in a direction to form a latent electrostatic image on a surface thereof through the laser scanning unit, and having a developing roller developing the latent electrostatic image into a toner image with a developer;

a transfer part transferring the toner image onto a transported printing paper disposed on a paper-transporting path to engage the photosensitive element; and a subsidiary transfer part having a light source disposed on a side of the paper-transporting path to expose the photosensitive element to light and thereby to enhance a transfer efficiency, and having an optic fiber guide disposed longitudinally along the photosensitive element to lead the light generated from the light source to the photosensitive element, the optic fiber guide having a reflective part disposed on an outer surface thereof, the reflective part including a plurality of fluorescent material surfaces, each of which is formed to have a different area according to a distance between the light source and corresponding ones of the fluorescent material surfaces.

2. The apparatus according to claim 1, wherein the optic fiber guide comprises:

a core having a light-influx surface disposed toward the light source and a light-diffusion surface disposed toward the photosensitive element to lead the light toward the photosensitive element; and wherein the reflective part is disposed on an outer surface of the core to diffuse and reflect the light toward the light-diffusion surface of the core.

3. The apparatus according to claim 2, wherein the core has cladding formed on the outer surface of the core except for the light-influx surface and the light-diffusion surface.

4. The apparatus according to claim 2, wherein the developing device comprises a frame, and the optic fiber guide further comprises:

a holder fixing the optic fiber guide on the frame to expose the light-influx surface and the light-diffusion surface to an outside of the optic fiber guide so as to lead the light toward the photosensitive element.

5. The apparatus according to claim 2, wherein the different areas of the fluorescent material surfaces become smaller when the fluorescent material surfaces are disposed closer to the light source.

6. The apparatus according to claim 2, wherein the light source comprises:

a pre-transfer lamp having an LED.

7. An image forming apparatus, comprising:

a laser scanning unit;

a developing device having a photosensitive element rotating in a direction to form a latent electrostatic image on a surface thereof through the laser scanning unit, and having a developing roller developing the latent electrostatic image into a toner image with a developer;

a transfer part transferring the toner image onto a transported printing paper disposed on a paper-transporting path to engage the photosensitive element; and an erasing part having an eraser lamp disposed on a side of the photosensitive element to generate light to erase an electrical charge remaining on the surface of the photosensitive element after the toner image is transferred onto the transported printing paper by the transfer part, and having an optic fiber guide disposed longitudinally along the photosensitive element to lead the light generated from the eraser lamp onto the photosensitive element, the optic fiber guide having a reflective part including a plurality of fluorescent material surfaces, each of which is formed to have a different area according to a distance between the eraser lamp and corresponding ones of the fluorescent material surfaces.

8. An image forming apparatus, comprising:

a laser scanning unit;

a developing device having a photosensitive element having a latent electrostatic image on a surface thereof through the laser scanning unit, and having a developing roller developing the latent electrostatic image into a toner image with a developer; and a subsidiary transfer part having a light source disposed on a side of the photosensitive element to generate light, and having an optic fiber guide having a light-influx surface facing the light source to receive the light and a core extended from the light-influx surface to be disposed longitudinally along the photosensitive element to lead the light generated from the light source to the photosensitive element to uniformly expose the photosensitive element to the light, the optic fiber guide having a reflective part including a plurality of fluorescent material surfaces, each of which is formed to have a different area according to a distance between the light source and corresponding ones of the fluorescent material surfaces.

9. The apparatus according to claim 8, wherein the optical fiber guide comprises:

an optic fiber.

10. The apparatus according to claim 8, wherein the photosensitive element comprises sidewalls and a cylindrical circular surface disposed between the sidewalls, and the light source of the subsidiary transfer part is disposed adjacent to one of the sidewalls of the photosensitive element.

11. The apparatus according to claim 10, wherein the core of the subsidiary transfer part is disposed adjacent to the cylindrical circular surface of the photosensitive element along a longitudinal direction.

12. The apparatus according to claim 11, wherein the cylindrical circular surface of the photosensitive element comprises a longitudinal center axis parallel to the longitudinal direction.

13. The apparatus according to claim 11, wherein the cylindrical circular surface of the photosensitive element has a first length in the longitudinal direction, and the core of the optic fiber guide of the subsidiary transfer part has a second length in the longitudinal direction.

14. The apparatus according to claim 13, wherein the first length and the second length are the same.

15. The apparatus according to claim 13, wherein the first length of the cylindrical circular surface of the photosensitive element corresponds to a length of the latent electrostatic image in the longitudinal direction.

16. The apparatus according to claim 8, wherein the core of the optic fiber guide comprises:

a light-diffusion surface formed on the core in a longitudinal direction of the photosensitive element to face a longitudinal surface of the photosensitive element and emit the light transmitted through the core from the light source to the longitudinal surface of the photosensitive element.

17. The apparatus according to claim 16, wherein the core of the optical fiber guide comprises an outer surface, and the optical fiber guide comprises cladding covering the outer surface except the light-diffusion surface and the light-influx surface.

18. The apparatus according to claim 17, wherein the cladding comprises:

a material having an index of refraction lower than that of the core.

19. The apparatus according to claim 17, wherein the optical fiber guide comprises:

another reflective part formed on the cladding corresponding to the outer surface to diffuse and reflect the light toward the light-diffusion surface of the core.

20. The apparatus according to claim 8, further comprising:

a frame;

a paper-transporting path formed along the frame; and a transfer part transferring the toner image onto a transported printing paper passing through the paper-transporting path to engage the photosensitive element;

wherein the subsidiary transfer part exposes the photosensitive element to the light to enhance a transfer efficiency of the photosensitive element when the toner image is transferred from the photosensitive element to the transported printing paper by the transfer part.

21. The apparatus according to claim 20, wherein the subsidiary transfer part is disposed between the paper-transporting path and the photosensitive element.

22. The apparatus according to claim 20, wherein the developing device comprises a developing roller supplying the toner to the photosensitive element, and the subsidiary transfer part is disposed between the transfer part and the developing roller of the developing device.

23. The apparatus according to claim 8, further comprising:

a frame;

a paper-transporting path formed along the frame; and a transfer part transferring the toner image onto a transported printing paper passing through the paper-transporting path to engage the photosensitive element;

wherein the subsidiary transfer part is disposed around the photosensitive element opposite to the developing device to erase an electrical charge remaining on the photosensitive element after the toner image has been transferred onto the transported printing paper by the transfer part.

24. The apparatus according to claim 23, wherein the subsidiary transfer part is disposed between the laser scanning unit and the transfer part.

25. The apparatus according to claim 23, wherein the eraser part comprises:

an erasing lamp as the light source to generate the light which is guided by the optic fiber guide.

26. The apparatus according to claim 8, wherein the optic fiber guide comprises:

a cross-section having a rectangular shape, a circular shape, or a hollow pipe shape.

27. The apparatus according to claim 25, wherein the cross-section of the optic fiber guide comprises:

a light-diffusion surface facing a longitudinal surface of the photosensitive element and emitting the light transmitted through the core from the light source to the longitudinal surface of the photosensitive element; and another reflective part diffusing and reflecting the light toward the light-diffusion surface.

28. The apparatus according to claim 8, wherein the subsidiary transfer part comprises:

a second light source disposed on the core opposite to the light source to generate light.

29. The apparatus according to claim 28, wherein the optic fiber guide comprises:

a second light-influx surface facing the second light source to receive the light.

30. The apparatus according to claim 29, wherein the core is disposed between the light-influx surface and the second light-influx surface.

31. An image forming apparatus, comprising:

a laser scanning unit;

a developing device having a photosensitive element having a latent electrostatic image on a surface thereof through the laser scanning unit, and having a developing roller developing the latent electrostatic image into a toner image with a developer; and a subsidiary transfer part having a light source disposed on a side of the photosensitive element to generate light, and having an optic fiber guide having a light-influx surface facing the light source to receive the light and a core extended from the light-influx surface to be disposed longitudinally along the photosensitive element to lead the light generated from the light source to the photosensitive element to uniformly expose the photosensitive element to the light, wherein the core of the optic fiber guide comprises:

a light-diffusion surface formed on the core in a longitudinal direction of the photosensitive element to face a longitudinal surface of the photosensitive element and emit the light transmitted through the core from the light source to the longitudinal surface of the photosensitive element, wherein the core of the optical fiber guide comprises an outer surface, and the optical fiber guide comprises cladding covering the outer surface except the light-diffusion surface and the light-influx surface, and wherein the reflective part includes:

a first fluorescent material surface having a first area; and a second fluorescent material surface having a second area different from the first area.

32. The apparatus according to claim 31, wherein the first fluorescent material surface is spaced-apart from the light-influx surface by a first distance, and the second fluorescent material surface is spaced apart from the light-influx surface by a second distance different from the first distance.

33. The apparatus according to claim 32, wherein the first distance is shorter than the second distance.

34. The apparatus according to claim 33, wherein the first area of the first fluorescent material surface is smaller than the second area of the second fluorescent material surface.

35. The apparatus according to claim 31, wherein the first fluorescent material surface is spaced-apart from the second fluorescent material surface.

36. The apparatus according to claim 31, wherein the first fluorescent material surface is disposed adjacent to the light-influx surface, and the second fluorescent material surface is disposed adjacent to the light-diffusion surface.

37. An image forming apparatus, comprising:

a laser scanning unit having a first light source;

a developing device having a photosensitive element rotating about an axis and having a latent electrostatic image on a surface thereof through the laser scanning unit, and having a developing roller developing the latent electrostatic image into a toner image with a developer;

a second light source generating light different from a first light source of the laser scanning unit; and an optic fiber receiving the light from the second light source, disposed to be parallel to the axis of the photosensitive element, and uniformly exposing a longitudinal surface of the photosensitive element parallel to the axis of the photosensitive element to lower a voltage potential of the toner image of the photosensitive element, the optic fiber having a reflective part including a plurality of fluorescent material surfaces, each of which is formed to have a different area according to a distance between the second light source and corresponding ones of the fluorescent material surfaces.

38. The apparatus according to claim 37, wherein the optic fiber has a length in a direction parallel to the axis of the photosensitive element, and the length of the optic fiber corresponds to that of the latent electrostatic image in the direction.

39. The apparatus according to claim 37, further comprising:

a transfer part transferring the toner image onto a transported printing paper passing through a paper-transporting path to engage the photosensitive element, wherein the optic fiber is disposed around the photosensitive element between the transfer part and the developing device to enhance a transfer efficiency of the photosensitive element when the toner image is transferred from the photosensitive element to the transported printing paper by the transfer part.

* * * * *

UNITED STATES PATENT AND TRADEMARK OFFICE

CERTIFICATE OF CORRECTION

PATENT NO. : 7,027,757 B2
APPLICATION NO. : 10/387859
DATED : April 11, 2006
INVENTOR(S) : Su-jong Jeong It is certified that error appears in the above-identified patent and that said Letters Patent is hereby corrected as shown below:

Column 12, line 61, change “spaced apart” to --space-apart--

Signed and Sealed this

Eighth Day of August, 2006

JON W. DUDAS
*Director of the United States Patent and Trademark Office*